US008162148B2

(12) United States Patent
Miedema et al.

(10) Patent No.: US 8,162,148 B2
(45) Date of Patent: Apr. 24, 2012

(54) WEIGHT FILLING DEVICE FOR SMALL OBJECTS

(75) Inventors: Randy Miedema, Zeeland, MI (US); Jeff Miedema, Hudsonville, MI (US); Denny Schepel, Holland, MI (US); Mike Miedema, Holland, MI (US)

(73) Assignee: Lakewood Process Machinery, Holland, MI (US)

( * ) Notice: Subject to any disclaimer, the term of this patent is extended or adjusted under 35 U.S.C. 154(b) by 106 days.

(21) Appl. No.: 12/798,322

(22) Filed: Apr. 1, 2010

(65) Prior Publication Data

US 2011/0240530 A1 Oct. 6, 2011

(51) Int. Cl.
*B07B 1/00* (2006.01)
*B07B 13/00* (2006.01)

(52) U.S. Cl. ..... 209/309; 209/307; 209/920; 209/925; 209/674

(58) Field of Classification Search ..... 209/307, 209/309, 379, 665, 668, 670, 674, 920–925
See application file for complete search history.

(56) References Cited

U.S. PATENT DOCUMENTS

| | | | | |
|---|---|---|---|---|
| 4,094,127 | A * | 6/1978 | Romagnoli | 53/51 |
| 5,810,175 | A * | 9/1998 | Williamson | 209/665 |
| 6,189,702 | B1 * | 2/2001 | Bonnet | 209/651 |
| 2003/0201211 | A1 * | 10/2003 | Bennett et al. | 209/586 |
| 2011/0240530 | A1 * | 10/2011 | Miedema et al. | 209/337 |

* cited by examiner

*Primary Examiner* — Terrell Matthews
(74) *Attorney, Agent, or Firm* — The Watson I.P. Group, PLC; Jovan N. Jovanovic; Vladan M. Vasiljevic

(57) ABSTRACT

A weight filling device for filling small objects comprising a vibrating feed assembly, at least two bins in a side by side orientation, and a chute assembly. The feed assembly includes feed stations having a feed tray with a large feed portion and a small feed portion in a side by side orientation, either integrally formed along a part or all of the length thereof, and each extending to a distal end thereof and vibrating at a predetermined frequency. The bins are positioned so as to be placeable in communication with the distal end of the at least one feed tray. The chute assembly is positioned below the distal end of the at least one feed tray, and has at least one directing chute station having a large feed selector positioned below the large feed portion of the feed tray and a small feed selector positioned below the small feed portion of the feed tray. The large feed selector and the small feed selector are independently pivotable relative to each other between a first position and a second position to direct small objects into the proper bin. The frame for holding the containers to be filled is also vertically adjustable.

8 Claims, 6 Drawing Sheets

WEIGHT FILLING DEVICE FOR SMALL OBJECTS

BACKGROUND OF THE DISCLOSURE

1. Field of the Disclosure

The disclosure relates in general to filling equipment that typically fills by weight, and more particularly, to weight filling equipment for small objects, such as, for example, berries. It will be understood that the invention is not limited to the filling of any particular small objects, but that berries are exemplary in nature.

2. Background Art

The filling of containers with small objects, such as blueberries, and the like, is known in the art. Typically, the small objects (also referred to herein as product) are directed from a bulk storage member, such as a hopper, through various mechanisms that fill the containers by weight. Of course, the productivity of the overall filling equipment is gauged by how quickly the product can be gathered to a particular weight and then dropped into a container. Thus, such equipment operates substantially continuously.

Among other problems, it is often difficult to easily meter the product when getting close to the desired weight. Generally, the product is fed quickly until a weight that is close to the final weight is reached; at such time, the product flow rate is much slower so as to controllably arrive at the desired weight without appreciably going over the desired weight. Often, the quick feed rate and the slow feed rate are related, and, as such it is difficult to optimize either. Thus, the quick feed rate may suffer to insure that the slow feed rate is acceptable. Conversely, the slow feed rate may suffer to insure that the quick feed rate is acceptable.

Additionally, it is often difficult to efficiently and quickly direct product between a plurality of product bins. Generally, multiple product bins are available to feed a single container positioned therebelow. Thus, when either product bin is full, it can be emptied while the other bin is being filled for a subsequent container. Thus, the filling of bins can be a continuous process, while the filling of containers is indexed. Often, it is difficult to inexpensively and accurately switch between bins, and the equipment utilized to do so is often cumbersome.

Still other difficulties comprise the ability to easily adapt the filling devices for differently sized and shaped containers. Often, the height of the container forms a limitation as the container approaches the bottom of the bins. Additionally, it is difficult to accommodate bins of different lengths as the conveyors are structurally configured to accept a narrow range of container lengths.

SUMMARY OF THE DISCLOSURE

The disclosure is directed to a weight filling device for filling small objects comprising a vibrating feed assembly, at least two bins and a chute assembly. The vibrating feed assembly has at least one feed station. The feed station has at least one feed tray with a large feed portion and a small feed portion in a side by side orientation, each extending to a distal end thereof. A vibrating device imparts vibration to the feed tray at a predetermined frequency. The at least two bins are positioned in a side by side orientation, and placeable in communication with the distal end of the at least one feed tray. The chute assembly is positioned below the distal end of the at least one feed tray. The chute assembly has at least one directing chute station having a large feed selector positioned below the large feed portion of the feed tray and a small feed selector positioned below the small feed portion of the feed tray. The large feed selector and the small feed selector are each pivotable between at least a first position wherein the large feed selector and the small feed selector direct small objects from the distal end of the feed tray into a first of the at least two bins and a second position wherein the large feed selector and the small feed selector direct small objects from the distal end of the feed tray into the second of the at least two bins. The large feed selector and the small feed selector are independently pivotable relative to each other between the first position and the second position.

In some embodiments, the at least one directing chute station is defined by a pair of opposing walls with at least one axle extending therebetween. The large feed selector and the small feed selector are pivotably positioned on the at least one axle, with the axle forming the axis of pivoting of the large feed selector and the small feed selector.

In some embodiments, the large feed selector is at least five times wider than the small feed selector.

In another embodiment, the device further comprises a package conveyor assembly having a frame with a first conveyor and a second conveyor in a side by side orientation. Each of the first and second conveyors include a plurality of vertical stops extending therefrom, with a container to be filled being placed on the first and second conveyors simultaneously. Further independent adjustment of the first conveyor relative to the second conveyor is provided, to, in turn, adjust the position of the vertical stops of the first conveyor relative to the vertical stops of the second conveyor. Thus, the conveyor can facilitate the filling of differently sized containers.

In a preferred embodiment, the frame further includes a vertical adjustment assembly structurally configured to raise and lower the frame relative to the chute assembly. This, in turn, facilitates the filling of containers of varying height.

In one such preferred embodiment, the vertical adjustment assembly comprises a rotational handle and an assembly to convert rotation of the handle to linear movement of the frame, thereby raising and lowering the frame relative to the chute assembly.

In another embodiment, at least one of the feeder stations include a tray wherein the small feed portion is separated from the large feed portion along at least a portion thereof stemming from the distal end, and further including a vibration device for each of the large feed portion and the small feed portion. The vibration devices are configured to oscillate each of the large feed portion and the small feed portion independently of each other at a desired predetermined frequency.

In one such embodiment, the frequency at which the large feed portion oscillates is different than the frequency at which the small feed portion oscillates.

In one such embodiment, each of the feeder stations include a tray wherein the small feed portion is separated from the large feed portion along at least a portion thereof stemming from the distal end, and further including a vibration device for each of the large feed portion and the small feed portion. The vibration devices are configured to oscillate each of the large feed portion and the small feed portion independently of each other at a desired predetermined frequency.

In another aspect of the invention, the invention includes a weight filling device for filling small objects including a vibrating feed assembly, at least one bin and a chute assembly. The vibrating feed assembly includes at least one feed station. The feed station has at least one feed tray with a large feed portion and a small feed portion in a side by side orientation each extending to a distal end thereof. The at least one of the feeder stations include a tray wherein the small feed portion is separated from the large feed portion along at least a portion thereof stemming from the distal end. A vibration device is provided for each of the large feed portion and the small feed portion. The vibration devices are configured to oscillate each of the large feed portion and the small feed portion independently of each other at a desired predetermined frequency. The at least one bin is positioned so as to be placeable in communication with the distal end of the at least one feed tray. The chute assembly is positioned below the distal end of the at least one feed tray directing the small objects to the at least one bin.

In a preferred embodiment, the frequency at which the large feed portion oscillates is different than the frequency at which the small feed portion oscillates.

In another preferred embodiment, the vibrating feed assembly includes a plurality of feed stations. Each of the feeder stations include a tray wherein the small feed portion is separated from the large feed portion along at least a portion thereof stemming from the distal end. A vibration device is provided for each of the large feed portion and the small feed portion. The vibration devices are configured to oscillate each of the large feed portion and the small feed portion independently of each other at a desired predetermined frequency.

In yet another aspect of the invention, the invention comprises a weight filling device for filling small objects comprising: a vibrating feed assembly, at least one bin, a chute assembly and a package conveyor assembly. The vibrating feed assembly has at least one feed station. The feed station has at least one feed tray with a large feed portion and a small feed portion in a side by side orientation each extending to a distal end thereof. Further, a vibrating device imparts vibration to the feed tray at a predetermined frequency. The at least one bin is positioned so as to be placeable in communication with the distal end of the at least one feed tray. The chute assembly is positioned below the distal end of the at least one feed tray directing the small objects to the at least one bin. The package conveyor assembly has a frame with a first conveyor and a second conveyor in a side by side orientation. Each of the first and second conveyors include a plurality of vertical stops extending therefrom, with a container to be filled being placed on the first and second conveyors simultaneously. An independent adjustment of the first conveyor relative to the second conveyor is provided, to, in turn, adjust the position of the vertical stops of the first conveyor relative to the vertical stops of the second conveyor, thereby facilitating the filling of differently sized containers.

In a preferred embodiment, the frame further includes a vertical adjustment assembly structurally configured to raise and lower the frame relative to the chute assembly, to, in turn, facilitate the filling of containers of varying height.

In another embodiment, the vertical adjustment assembly comprises a rotational handle and an assembly to convert rotation of the handle to linear movement of the frame, thereby raising and lowering the frame relative to the chute assembly.

BRIEF DESCRIPTION OF THE DRAWINGS

The disclosure will now be described with reference to the drawings wherein.

DETAILED DESCRIPTION OF THE DISCLOSURE

Figure 1:
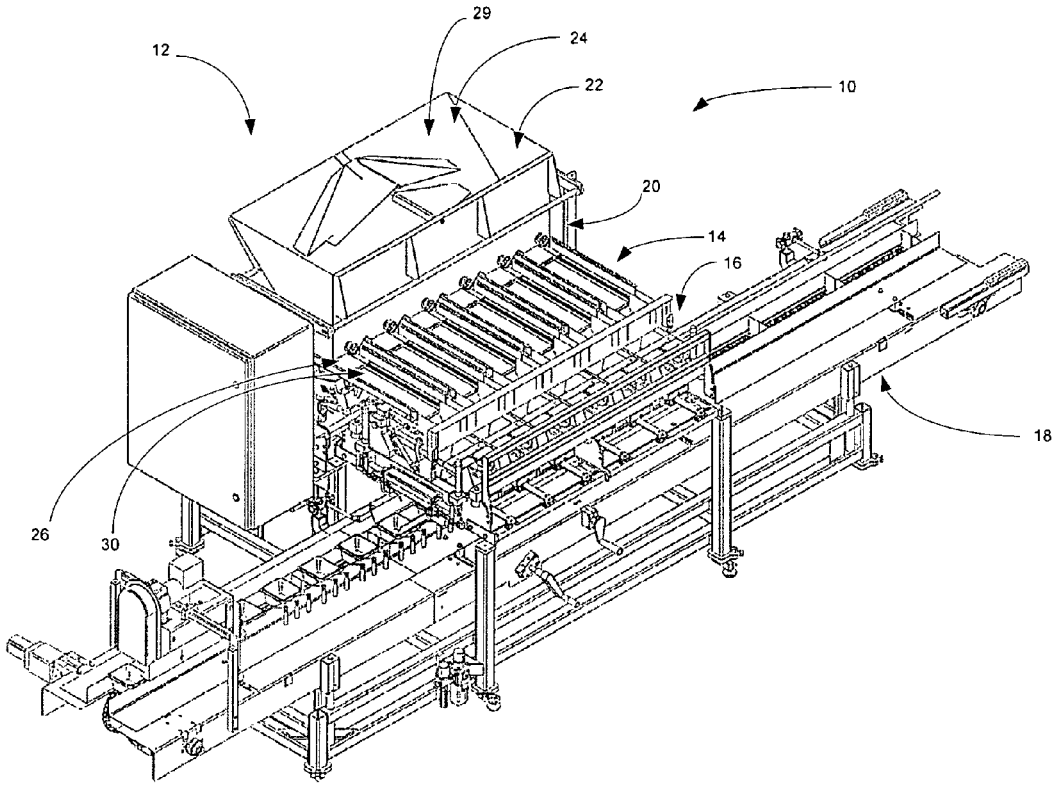
FIG. 1 of the drawings is a perspective view of the weight filling device of the present invention.
Figure 2:
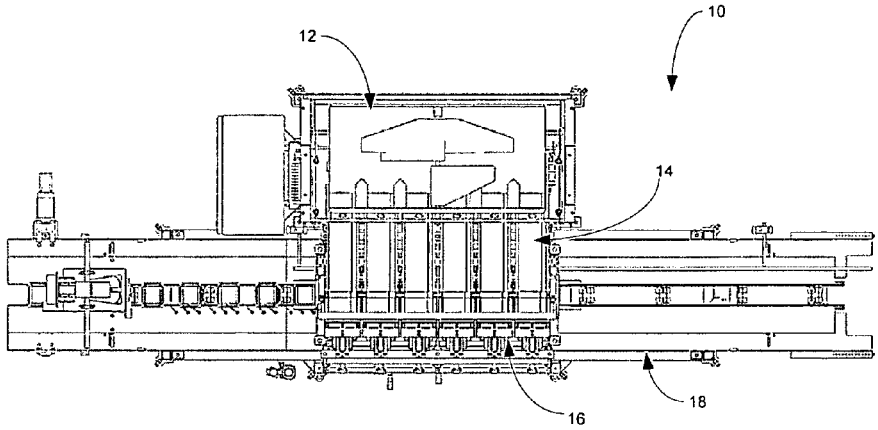
FIG. 2 of the drawings is a top plan view of the weight filling device of the present invention.
Figure 3:
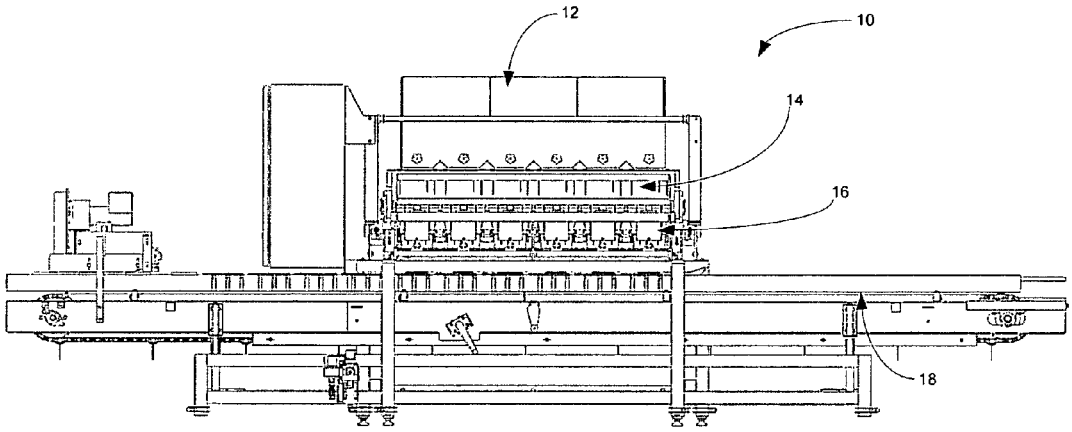
FIG. 3 of the drawings is a side elevational view of the weight filling device of the present invention.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the weight filling device for small objects is shown generally at 10. The device comprises a hopper 12, a vibrating feeder assembly 14, chute assembly 16 and package conveyor assembly 18. The weight filling device 10 is configured to fill objects such as berries (i.e., blueberries) and the like into substantially rigid packaging. In certain assemblies, the packaging generally comprises a clear polymer container defining a cavity and having a cover positioned thereover. Of course, the invention is not limited to filling blueberries into containers, or any other type of berries, or to any particular item. Additionally, while small items are referenced, such a term is relative. For example, objects like potatoes and egg plants or other such sized objects are likewise contemplated.

The hopper is shown in FIG. 1 as comprising a base 20, upstanding walls 22, upper opening 24 and lower openings, such as lower opening 26. The base 20 is positioned over the vibrating feeder assembly 14, with a lower opening being positioned above each of the feeder stations 30. The upstanding walls 22 assist to define a storage cavity 29 which is of suitable size to accommodate the flow rates and fill rates desired. The hopper is filled through the upper opening 24. In the embodiment shown, the upper opening 24 is defined by the bounds of the upstanding walls 22. The upstanding walls 22 also have a funnel like configuration which directs the small objects to the lower openings 26.

The vibrating feeder assembly 14 is shown in FIG. 1 as comprising a plurality of feeder stations, such as feeder station 30. The feeder stations are configured to drive product from the hopper to the chute assembly 16. Each feeder station 30 is substantially similar in configuration and operation, so feeder station 30 will be described with the understanding that the remaining feeder stations are substantially identical.

Figure 4:
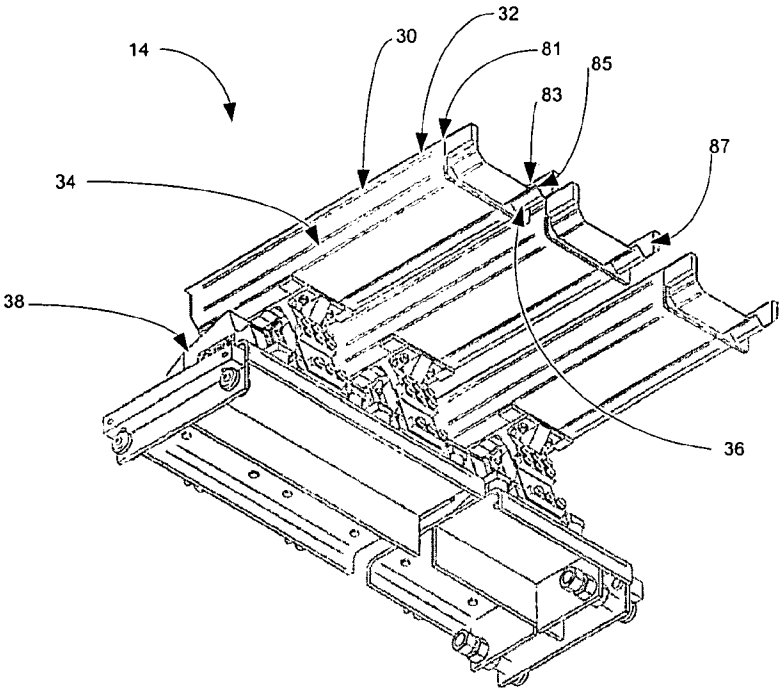
FIG. 4 of the drawings is a perspective view of the weight filling device of the present invention, showing, in particular, the vibrating feeder assembly.

With reference to FIG. 4, feeder station 30 is shown as comprising feed tray 32 and vibration device 38. The feed tray 32 is substantially horizontal and extends from a proximal end approximately a position below the lower opening of the hopper 26 to a distal end which overlies the chute assembly 16. The feed tray 32 includes a large feed portion 34 and a small feed portion 36. The large feed portion 34 comprises a substantially planar surface with raised side edges 81, 83 which define a channel along which product can travel. The small feed portion 36 includes a substantially planar surface with raised side edges 85, 87 which define a channel along which product can likewise travel. The planar surface of the large feed portion 34 is typically three to seven times wider than the planar surface of the small feed portion. The relative sizing of the large feed portion and the small feed portion can be varied within the scope of the invention, and will be largely determined by the size of the product, and the size of the container. In the embodiment shown, the small feed portion 36 has a width that allows for product to proceed single file.

In the embodiment shown, the large feed portion 34 and the small feed portion 36 comprise an element of singular construction wherein the two are coupled along substantially the entire length thereof. Additionally, the two feed portions are controlled by a single vibration device 38. The vibration device 38 oscillates the feed tray 32 (and, simultaneously the large feed portion and the small feed portion) at a predetermined oscillation rate. It will be understood that this rate can be decreased or increased as desired to impart a different travel rate to the small objects traversing the feed tray. Such vibrating devices 38 are well known to those of skill in the art. It will be understood that a gate can be selectively positioned at the distal end of each feed tray to positively preclude movement of the product beyond the feed tray (which may be necessary if the bin station is not capable of receiving product at any given time from a station). In certain embodiments, the vibration device includes a feed tray that is not segmented, but, rather includes a blocking device which can block a portion of the flow. Thus, when not blocked, the entire flow comprises the large feed portion, and when blocked, the flow is restricted to a small feed portion.

Figure 5:
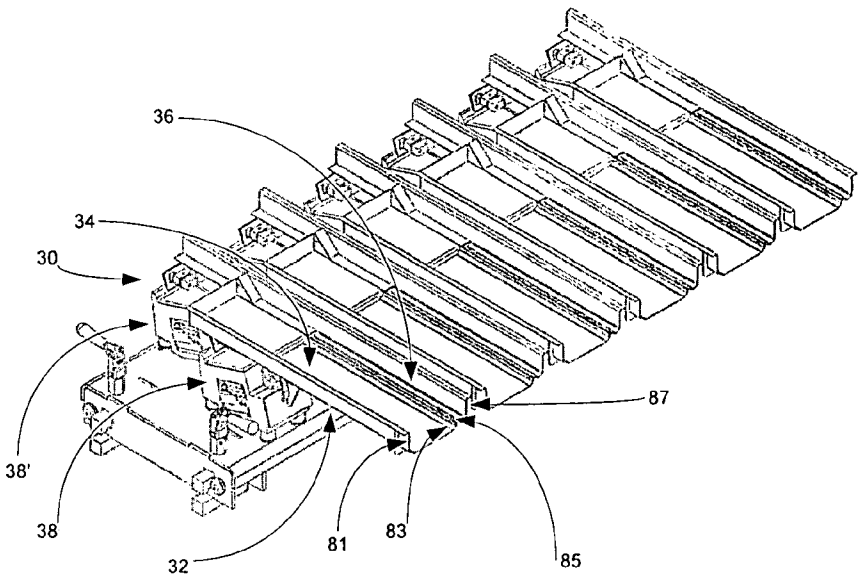
FIG. 5 of the drawings is a perspective view of the weight filling device of the present invention, showing, in particular, a second embodiment of the vibrating feeder assembly.

In other embodiments, such as the embodiment shown in FIG. 5, the large feed portion 34 and the small feed portion 36 may be separated along at least a portion of the length thereof. Such separation allows for the two feed portions to move independently of each other. Additionally, in certain embodiments, separate vibration devices 38, 38' can be utilized for each of the small feed portion and the large feed portion. Each separate vibration device can be directed to oscillate at relatively different frequencies. As such, additional control can be imparted to the filling process by separately controlling the rate of movement of the small objects on the large feed portion 34 vis-à-vis the small feed portion 36.

Figure 6:
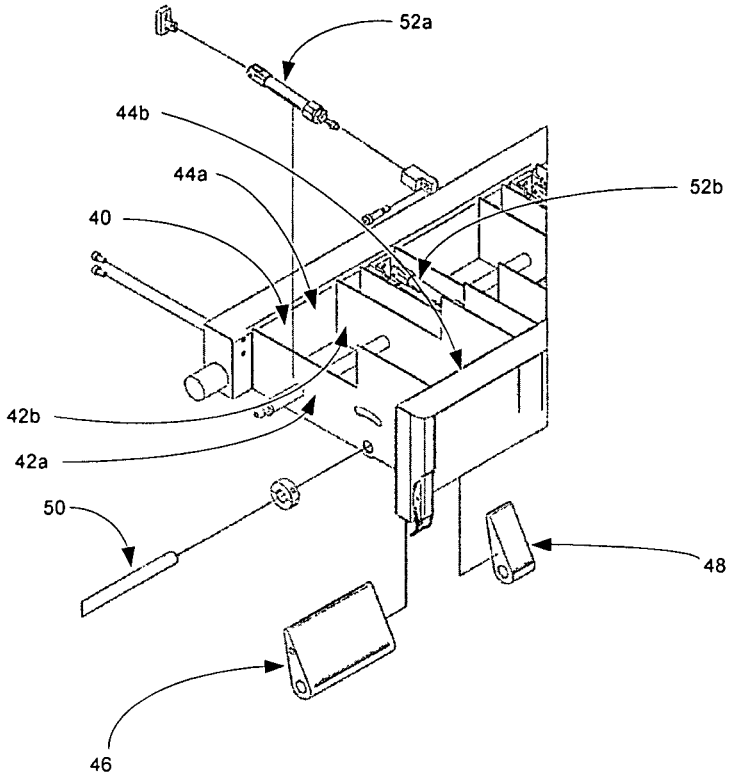
FIG. 6 of the drawings is an exploded perspective view of the weight filling device of the present invention, showing, in particular, the directing chute station.
Figure 7:
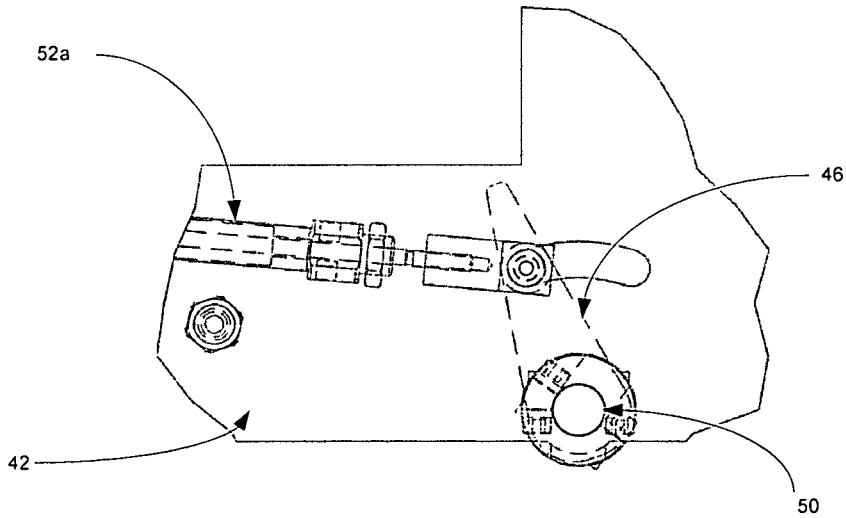
FIG. 7 of the drawings is a partial side elevational view of the weight filling device of the present invention, showing, in particular, the directing chute station.
Figure 8:
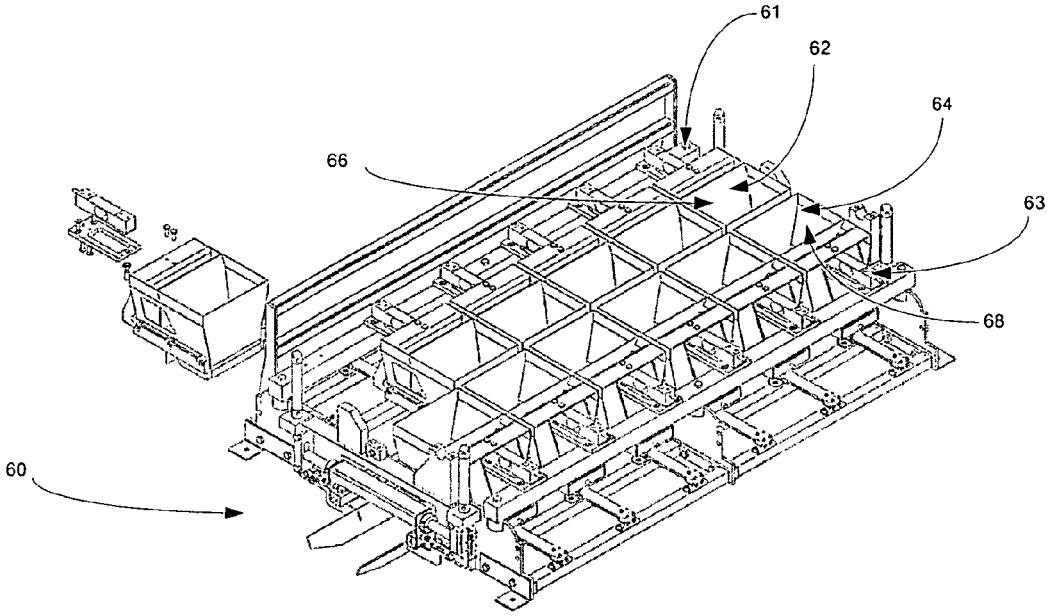
FIG. 8 of the drawings is a perspective view of the weight filling device of the present invention, showing, in particular, the bin stations of the chute assembly.

The chute assembly 16 is shown in FIGS. 6-8 as comprising a plurality of directing chute stations, such as directing chute station 40 and a plurality of corresponding bin stations 60. The individual chute stations are positioned in a generally side by side orientation and below a respective one of the distal ends of a feed tray of a feeder station of the vibrating feeder assembly. The directing chute station 40 will be described with the understanding that the remaining directing chute stations 40 are substantially identical. Each directing chute station 40 includes opposing side walls 42*a*, 42*b*, end walls 44*a* and 44*b* to define a substantially rectangular chute. Of course, the chute station is not required to have any particular cross-sectional shape or configuration.

Each directing chute station lies above the respective bin station 60. Each bin station 60 includes proximal bin 62 and distal bin 64. Proximal bin 62 includes a plurality walls 66 and an opening defined by the upper ends of the walls to provide ingress into the proximal bin 62. Similarly distal bin 64 includes a plurality of walls 68, and an opening defined by the upper ends of the walls to provide ingress into the distal bin 64. Each of the proximal bin and the distal bin further include sensors which are configured to determine the weight of the small objects that are placed inside. The sensors are coupled to the control unit which utilizes the information gathered from the sensors to determine, among other things, when the proximal bin and/or distal bin is loaded to the requisite weight capacity. An opening is positioned below to allow release of product.

The two side by side bin stations are configured to receive the small objects from the directing chute stations. The directing chute stations are configured to fill the proximal and distal bins as desired. To fill the proximal and distal bins, the directing chute stations further include a large feed selector 46, and a small feed selector 48. Together the two feed selectors extend from one side of the directing chute stations and comprise flipper like wall configurations.

The two feed selectors are both pivotable about axle 50 extending therethrough, near the bottom end of the feed selectors, such that the feed selectors pivot close to a bottom edge thereof. The position of the feed selectors is controlled by the linkages that can be controlled by pneumatic cylinders, solenoids, stepper motors and the like. It will be understood that the two feed selectors of any of the direction chute stations may pivot on separate axles which may or may not be coaxial themselves.

With respect to the large feed selector 46, the same is configured to pivot between a first orientation and a second orientation which is arcuately separated from the first orientation. In a first orientation, the large feed selector 46 is configured to direct the small objects into the proximal bin. In the second orientation, the large feed selector 46 is configured to direct the small objects into the distal bin. The large feed selector 46 is directed between the first and second orientation by the linkages which are driven by the outside devices in accordance to instructions from the controller (which is at least partially based upon the sensed weight in either one or both of the proximal bin 62 and the distal bin 64).

Similarly, with respect to the small feed selector 48, the same is configured to pivot between a first orientation and a second orientation which is arcuately separated from the first orientation. In a first orientation, the small feed selector 48 is configured to direct the small objects into the proximal bin. In a second orientation, the small feed selector 48 is configured to direct the small objects into the distal bin. The small feed selector 48 is directed between the first and second orientation by the linkages which are driven by the outside devices in accordance to instructions from the controller (which, again, is at least partially based upon the sensed weight in either one or both of the proximal bin 62 and the distal bin 64).

It will be understood that as one of the bins is filled, the feed selectors are directed to drive product into the other of the bins. Each bin further includes a bottom opening that is selectively movable. As such, the opening can be opened to allow product from either of the distal bin and the proximal bin into the container below. It will be explained below that the door may open on, for example, the proximal bin to allow product from the proximal bin to be directed into the containers below while the distal bin is being filled with product.

Figure 9:
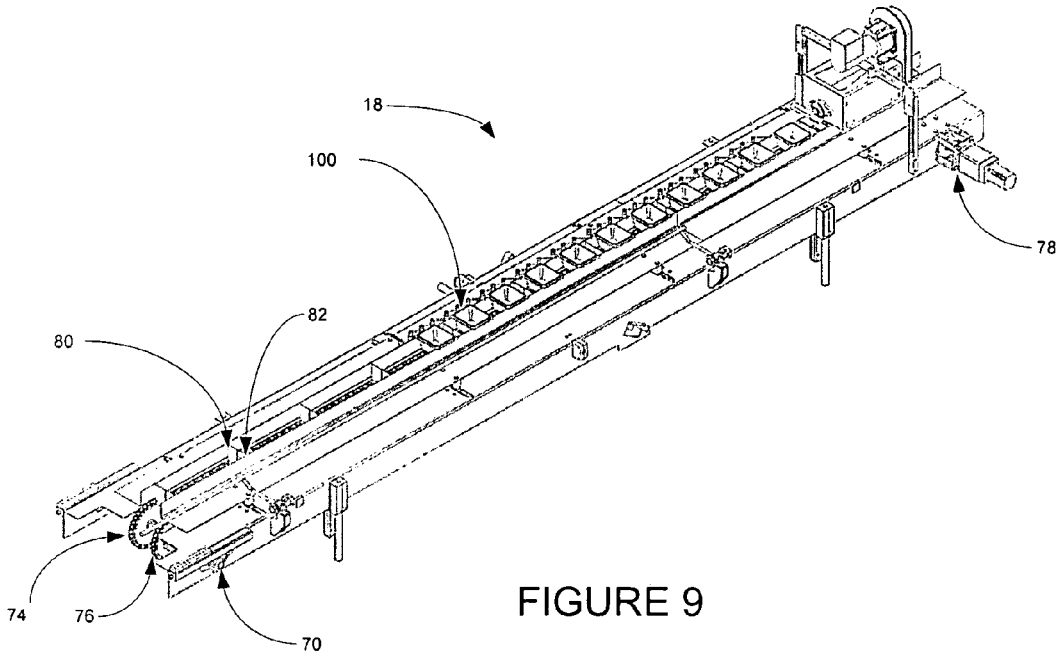
FIG. 9 of the drawings is a perspective view of the weight filling device of the present invention, showing, in particular, the package conveyor assembly.
Figure 10:
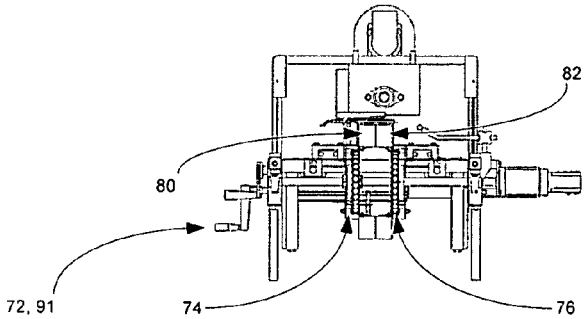
FIG. 10 of the drawings is a front elevational view of the weight filling device of the present invention, showing, in particular, the package conveyor assembly.

The package conveyor assembly 18 is shown in FIGS. 9 and 10 as comprising frame 70, first conveyor 74, second conveyor 76 and independent adjustment member 78. The frame includes a vertical adjustment assembly 72 to adjust the distance between the conveyor and the bin stations 60 so as to accommodate a number of containers of different height. The vertical adjustment assembly 72 comprises a handle member 91 which is rotated. The rotation is converted into vertical linear movement through a number of different devices, such as a screw thread system or a gearing system. Such a system is understood to one of skill in the art. As such, not only is clearance for the containers provided, but also, the conveyor can be positioned to minimize the travel of the product from the bin stations 60 into the container on the package conveyor assembly. The first and second conveyors generally travel in parallel and are positioned in a side by side orientation. Each of the conveyors includes a vertical stops 80, 82, respectively. These vertical stops cooperate with the package so that the package travels along the conveyor without slippage relative to the conveyor. Advantageously, the position of the vertical stops 80 can be adjusted relative to the position of the vertical stops 82 by rotating the first conveyor 74 while keeping the second conveyor 76 in a fixed orientation. Typically, this is done through the independent adjustment assembly 78 which allows for the first conveyor to move relative to the second conveyor. It will be understood that the conveyors can be adjusted each time a different package or container of a different size is to be filled.

It will be known to those of skill in the art that a controller system will likewise be provided to control the operation of the filling device. In particular, such a controller system is typically controlled by a microprocessor based system (in some embodiments by a PC) which receives input from each of the systems and provides output to those systems that it can control. For example, among other inputs, the weight of the hopper, the frequency of the vibration of each of the feed trays, the position of the large and small feed selectors in each station, the weight of the distal and proximal bins of each station, the position of the containers below the bins, the speed and orientation of the conveyors, among other parameters. The controller then directs the release of material from the hopper, through an adjustable opening or the like, the frequency at which the feed trays vibrate, the position of the large and small feed selectors of each station, the timing of the release of product from either one of the bins, the movement of the conveyor, among other parameters. Such a controller assembly is known to one of skill in the art. Although certain parameters, inputs and outputs may be new to one of skill in the art, one of skill in the art with the present disclosure before them would have an understanding as to how to program such a controller based upon the parameters, inputs and outputs presently disclosed.

The operation of the system will be described with respect to filling of containers with blueberries. As stated previously, the invention is not limited to the use of any particularly sized containers or packages, or is the invention limited to blueberries, berries, fruit or any particularly sized and shaped product. First, an appropriately sized container is selected. The first conveyor 74 and the second conveyor 76 are next adjusted to accommodate the container that has been selected for filling. Additionally, through the vertical adjustment assembly, the frame of the conveyor assembly is adjusted in an upward or downward orientation.

Once the containers are in place and the conveyor is adjusted, containers are positioned underneath each of the bin stations 60. In the embodiment shown, a total of six stations are shown as being positioned in succession. As a result, six stations can be filled simultaneously. It will be understood that fewer or greater numbers of stations are contemplated.

Next, the product that is to be filled into the containers is placed into the hopper. In this case, the hopper is filled with blueberries to a desired capacity. It will be understood that the hopper can be filled from another remote device, such as a separate larger hopper by conveyor. It will also be understood that the hopper can be positioned remotely from the equipment, and conveyors, or other pathways can be provided by which to direct product from the hopper (or other storage device) to the vibrating feeder assembly. By positioning the hopper above the vibrating feeder assembly, a compact design is achieved. It will be understood that such a system is, however, not required.

The control assembly then directs the lower opening 26 of the hopper to release product at a particular rate. The same can be controlled by the size of the opening of the hopper (which can be adjustable), and/or the duration that the lower opening remains in an open configuration to allow for the passage of product.

The product exiting from the lower opening of the hopper drops onto the vibrating feeder assembly 14. In particular, product drops onto each feed tray of each feeder station. Due to the vibration of the feeder tray, product travels along each of the large feed portion and the small feed portion of the feeder tray toward the distal end thereof. The speed at which the product travels along the feed portions is controlled predominantly by the frequency the vibration device is imparting onto the feed tray.

Eventually, product reaches the distal end of the feed tray and falls off the feed tray. Due to gravity, the product is directed toward and into the chute assembly. For each station, the product that was travelling along the large feed portion contacts the large feed selector, and, in turn, is directed into one of the proximal bin and the distal bin. Similarly, the product that was travelling along the small feed portion contacts the small feed selector, and, in turn, is directed into one of the proximal bin and the distal bin. As identified above, depending on the condition of either bin in any particular station, it will be understood that the large feed portion can direct product into one bin, while the small feed portion is directing product into the other bin.

To describe the filling in greater detail, the filling of the proximal bin will be described. Initially, the large feed selector 46 and the small feed selector 48 are oriented so that product falling from the distal end of the feed tray hits the feed selectors and is directed into the proximal bin. As the weight of the product within the proximal bin is weighed, when the weight gets to a predetermined level, which is relatively close to, but less than the desired capacity of the bin, the large feed selector 46 is directed to the distal bin 64 while the small feed selector 48 remains directed to the proximal bin. As such, additional product, at a substantially slower feed rate (often product piece by product piece in single file) continues to trickle into the proximal bin. When the final weight is reached, the small feed selector 48 is reoriented so as to direct product into the distal bin as well. This process is repeated with the distal bin until it too is full.

As the distal bin is being filled, and after the proximal bin is filled to the desired weight, the bottom of the proximal bin opens to drop product into the awaiting container below. Once full, the container can be moved, and a new container is supplied under the bin station. This subsequent bin is typically filled with the contents of the distal bin which was being filled while the proximal bin was being emptied. This process is repeated continuously as containers are being filled.

As the same process is being repeated in each bin station 60 of the chute assembly 16. Typically, six containers are positioned below the bins. They are filled generally simultaneously from either one of the proximal bin or the distal bin of each of the bin stations of the chute assembly. In an indexed fashion, the six filled containers are then slid out and a new six containers are slid into position.

If any of the stations either lags behind the others (i.e., neither bin is filled when other stations have at least one bin filled), then adjustments can be made by the controller assembly. For example, the controller assembly can direct the feed tray of that particular feeder station to increase the frequency at which it oscillates, or it may adjust the frequency at which any of the other feed trays oscillate. If, bn the other hand, one of the stations is too far ahead (i.e., both bins are full, but other stations do not have one filled bin), then the controller assembly can again make adjustments. In that case, a physical guard may come down to physically block further product from falling off the end of the feed tray of that station, or, the controller assembly can adjust the frequency at which the feed tray oscillates. In an embodiment wherein two vibration devices 38, 38' are present, the controller assembly can alter the frequency at which either the large feed portion or the small feed portion of any one of the feed trays oscillates.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A weight filling device for filling small objects comprising:

a vibrating feed assembly having at least one feed station, the feed station having at least one feed tray with a large feed portion and a small feed portion in a side by side orientation each extending to a distal end thereof, and a vibrating device imparting vibration to the feed tray at a predetermined frequency;

at least one bin positioned so as to be placeable in communication with the distal end of the at least one feed tray;

a chute assembly positioned below the distal end of the at least one feed tray directing the small objects to the at least one bin; and a package conveyor assembly having a frame with a first conveyor and a second conveyor in a side by side orientation, each of the first and second conveyors including a plurality of vertical stops extending therefrom, with a container to be filled being placed on the first and second conveyors simultaneously, and further comprising an independent adjustment of the first conveyor relative to the second conveyor, to, in turn, adjust the position of the vertical stops of the first conveyor relative to the vertical stops of the second conveyor, thereby facilitating the filling of differently sized containers.

2. The weight device of claim 1 wherein the frame further includes a vertical adjustment assembly structurally configured to raise and lower the frame relative to the chute assembly, to, in turn, facilitate the filling of containers of varying height.

3. The weight device of claim 2 wherein the vertical adjustment assembly comprises a rotational handle and an assembly to convert rotation of the handle to linear movement of the frame, thereby raising and lowering the frame relative to the chute assembly.

4. The weight device of claim 1 wherein at least one of the feeder stations include a tray wherein the small feed portion is separated from the large feed portion along at least a portion thereof stemming from the distal end, and further including a vibration device for each of the large feed portion and the small feed portion, wherein the vibration devices are configured to oscillate each of the large feed portion and the small feed portion independently of each other at a desired predetermined frequency.

5. The weight device of claim 4 wherein the frequency at which the large feed portion oscillates is different than the frequency at which the small feed portion oscillates.

6. The weight device of claim 4 wherein each of the feeder stations include a tray wherein the small feed portion is separated from the large feed portion along at least a portion thereof stemming from the distal end, and further including a vibration device for each of the large feed portion and the small feed portion, wherein the vibration devices are configured to oscillate each of the large feed portion and the small feed portion independently of each other at a desired predetermined frequency.

7. The weight device of claim 1, wherein:

the at least one bin comprises at least two bins positioned in a side by side orientation, the at least two bins positioned so as to be placeable in communication with the distal end of the at least one feed tray; and the chute assembly further comprises at least one directing chute station having a large feed selector positioned below the large feed portion of the feed tray and a small feed selector positioned below the small feed portion of the feed tray, the large feed selector and the small feed selector each being pivotable between at least a first position wherein the large feed selector and the small feed selector direct small objects from the distal end of the feed tray into a first of the at least two bins and a second position wherein the large feed selector and the small feed selector direct small objects from the distal end of the feed tray into the second of the at least two bins, and wherein the large feed selector and the small feed selector are independently pivotable relative to each other between the first position and the second position.

8. The weight device of claim 7 wherein the at least one directing chute station is defined by a pair of opposing walls with at least one axle extending therebetween, the large feed selector and the small feed selector being pivotably positioned on the at least one axle, with the axle forming the axis of pivoting of the large feed selector and the small feed selector.

* * * * *